United States Patent [19]

Frantzreb, Sr.

[11] 4,152,150

[45] May 1, 1979

[54] PARTICULATE TREATING MATERIAL

[75] Inventor: John G. Frantzreb, Sr., Peoria, Ill.

[73] Assignee: Caterpillar Tractor Co., Peoria, Ill.

[21] Appl. No.: 858,981

[22] Filed: Dec. 9, 1977

[51] Int. Cl.[2] ..... C22C 37/04

[52] U.S. Cl. ..... 75/257; 75/48; 75/130 R

[58] Field of Search ..... 75/130 R, 48, 53, 257

[56] References Cited

U.S. PATENT DOCUMENTS

| | | | |
|---|---|---|---|
| 2,873,188 | 2/1959 | Bieniosek | 75/130 |
| 3,424,574 | 1/1969 | Irani | 75/53 |

*Primary Examiner*—M. J. Andrews

*Attorney, Agent, or Firm*—John W. Grant

[57] ABSTRACT

A particulate treating material includes a particulated inoculant coated with an inhibitor for retarding the physical reaction between the inoculant and the molten iron into which the treating material is introduced. When introduced into molten iron, the treating material promotes graphite formation and reduces chilling.

3 Claims, No Drawings

PARTICULATE TREATING MATERIAL

BACKGROUND OF THE INVENTION

This invention relates to the treating of molten iron. More particularly, the invention relates to the treating materials for nodulizing cast iron.

In the production of gray iron castings, small amounts of certain materials added to the molten iron just before pouring reduces chilling and promotes graphite formation. The common inoculants are graphite or materials having a high silicon content such as ferrosilicon or calcium silicide. To produce the maximum affects, silicon based inoculants require the presence of trace amounts of minor constituents such as aluminum, calcium, barium, strontium, or cerium. The graphite inoculant must be of high purity and highly crystalline.

Formerly, with cupola melting with coke as a fuel, large amounts of sulfur were introduced into the melt. Presently, with electric induction melting, iron with sulfur contents of below 0.04% by weight are common. The low sulfur iron has created a problem in that gray iron having less than 0.04% sulfur content does not readily respond to inoculation with graphite or many ferrosilicon based inoculants because these inoculants are dissolved very quickly at the low sulfur levels. Such phenomena is commonly referred to as "fading".

In a recently developed process of treating iron, the inoculant material is encapsulated within a metal tube in the form of a flexible wire and the wire fed into the molten iron being poured into the casting. However, although this process has greatly reduced the fading affect to an extent that high silicon content ferrosilicons can be used to inoculate the molten iron, the less costly graphite inoculant still tends to dissolve too quickly for effective inoculation in low sulfur irons.

SUMMARY OF THE INVENTION

The present invention is directed to overcoming one or more of the problems as set forth above.

According to the present invention, a particulate treating material includes a particulated inoculant coated with an inhibitor. When such treating material is introduced into molten iron, the inhibitor coating on the particles of inoculant retards the physical reaction between the inoculant and the molten iron.

DETAILED DESCRIPTION

The treating material of the invention is formed by mixing a particulated treating agent, for example an inoculant, with an inhibitor preferably having a particle size of less than about 2–5 microns. The amount of inhibitor required for the treating agent varies inversely with the size of the particles of the treating agent. For example, with the inoculant having particle sizes capable of passing through a fine seive mesh such as between Standard Nos. 30 to 140 (0.6 mm to 0.1 mm nominal diameter of the openings), the inhibitor constituting about 0.5% to 2.0% by weight of the treating material.

The inoculant is selected from the group consisting of graphite, ferrosilicon and calcium silicide. The inhibitor is selected from the group consisting of ferrous sulfide and sodium sulfite.

The treating material of the invention is preferably prepared by mixing the particulated constituents as by mulling or tumbling. The small particles of the inhibitor adhere to and thereby coat the relatively large particles of the inoculant.

In one example, the treating material includes particles of crystalline graphite as the inoculant and coated with ferrous sulfide as the inhibitor. The graphite has a particle size capable of passing through a Standard No. 60 (about 0.25 mm nominal diameter of the opening) fine seive mesh. The ferrous sulfide has a particle size of less than 5 microns and comprises about 1.5% by weight of the treating material.

In the preferred process for treating molten iron, the above particulate treating material, i.e., the inoculant coated with the inhibitor, is metered onto a metallic strip which is then rolled into a tube enclosing the treating material therein. The tube is then rolled or drawn down to a smaller size thereby reducing the wall thickness of the tube and compacting the treating material within the tube. Some of the larger particles of the treating material may be crushed during such compaction. The resultant article is a wire-like inoculant rod which can be precisely fed into the molten iron being poured into a casting mold. The molten iron melts the metallic sheath thereby releasing the particulate treating material to be carried into the casting cavity by the molten iron. The inhibitor coating melts and forms a shell of sulfide on the surface of the particles of treating agent. The sulfide shell in turn retards migration of the treating agent across the shell into the molten iron. Hence, the inhibitor coating delays the physical reaction between the inoculant and the molten iron thereby lengthening the time of effective inoculation and delaying the fading process.

Other aspects, objects and advantages of this invention can be obtained from a study of the drawings, the disclosure, and the appended claims.

The embodiments of the invention in which an exclusive property or privilege is claimed are defined as follows:

1. A particulate treating material for introduction into molten iron for promoting graphite formations and reducing chilling comprising:

a particulated inoculant and an inhibitor coating the particles of inoculant, said inhibitor consisting essentially of particulated articles being less than about 5 microns in size and constituting less than about 2.0% by weight of said treating material, said inhibitor being of a material sufficient for retarding the physical reaction between the inoculant and the molten iron; and wherein said inhibitor is selected from the group consisting of ferrous sulfide and sodium sulfite.

2. The particulate treating material of claim 1 wherein the inoculant is crystalline graphite.

3. The particulate treating material of claim 1 wherein the inoculant is a ferrosilicon having a silicon content of about 65%.

* * * * *